US010333239B2

(12) United States Patent
Ashibu et al.

(10) Patent No.: US 10,333,239 B2
(45) Date of Patent: Jun. 25, 2019

(54) CONNECTOR

(71) Applicant: JAPAN AVIATION ELECTRONICS INDUSTRY, LIMITED, Shibuya-ku, Tokyo (JP)

(72) Inventors: Kenta Ashibu, Tokyo (JP); Shingo Nanao, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/889,633

(22) Filed: Feb. 6, 2018

(65) Prior Publication Data

US 2018/0248287 A1 Aug. 30, 2018

(30) Foreign Application Priority Data

Feb. 28, 2017 (JP) ..... 2017-036100

(51) Int. Cl.
*H01R 12/00* (2006.01)
*H01R 12/71* (2011.01)
(Continued)

(52) U.S. Cl.
CPC ..... *H01R 12/716* (2013.01); *H01R 12/707* (2013.01); *H01R 13/115* (2013.01); *H01R 13/6273* (2013.01)

(58) Field of Classification Search
CPC .... H01R 9/091; H01R 12/70; H01R 12/7076; H01R 12/73
(Continued)

(56) References Cited

U.S. PATENT DOCUMENTS 5,931,689 A * 8/1999 Patel ..... H01R 12/716 439/346
7,172,434 B2 * 2/2007 Obikane ..... H01R 24/60 439/570
(Continued)

FOREIGN PATENT DOCUMENTS

CN 101820114 A 9/2010
CN 103098307 A 5/2013
(Continued)

OTHER PUBLICATIONS

Korean Office Action dated Dec. 7, 2018 (and English translation thereof) issued in counterpart Korean Application No. 10-2018-0010386.
(Continued)

*Primary Examiner* — Phuong Chi T Nguyen
(74) *Attorney, Agent, or Firm* — Holtz, Holtz & Volek PC

(57) ABSTRACT

A connector is mateable with a mating connector having two mating lock portions along an upper-lower direction. The connector comprises a housing and two additional members held by the housing. The housing has a projecting wall projecting upward in the upper-lower direction, an outer wall surrounding the projecting wall in a horizontal plane perpendicular to the upper-lower direction and a receiving portion which is a space formed between the outer wall and the projecting wall and partially receives the mating connector under a mated state of the connector with the mating connector. Each of the additional members has a lock portion. The two lock portions are located at opposite sides of the projecting wall, respectively, in a horizontal direction perpendicular to the upper-lower direction and face the receiving portion. Under the mated state, the lock portions lock the locked portions, respectively, to maintain the mated state.

10 Claims, 13 Drawing Sheets

(51) Int. Cl.
*H01R 13/115* (2006.01)
*H01R 12/70* (2011.01)
*H01R 13/627* (2006.01)

(58) Field of Classification Search
USPC ..... 439/55, 65, 74, 78
See application file for complete search history.

(56) References Cited

U.S. PATENT DOCUMENTS

| | | | | |
|---|---|---|---|---|
| 7,384,247 | B2 * | 6/2008 | Anderson | F04D 25/02 417/362 |
| 7,465,171 | B2 | 12/2008 | Miyazaki et al. | |
| 7,901,218 | B2 | 3/2011 | Sato et al. | |
| 8,961,215 | B2 | 2/2015 | Hasegawa | |
| 9,039,428 | B2 | 5/2015 | Suzuki et al. | |
| 9,236,672 | B2 | 1/2016 | Kuninaka | |
| 9,362,637 | B2 | 6/2016 | Hasegawa | |
| 9,666,963 | B2 | 5/2017 | He et al. | |
| 9,831,576 | B2 | 11/2017 | Wu et al. | |
| 2008/0268723 | A1 | 10/2008 | Miyazaki et al. | |
| 2010/0221928 | A1 | 9/2010 | Sato et al. | |
| 2013/0295784 | A1 | 11/2013 | Hasegawa | |
| 2013/0330943 | A1 | 12/2013 | Suzuki et al. | |
| 2014/0220817 | A1 | 8/2014 | Kuninaka | |
| 2015/0207256 | A1 | 7/2015 | Wu et al. | |
| 2015/0303597 | A1 | 10/2015 | He | |

FOREIGN PATENT DOCUMENTS

| | | | |
|---|---|---|---|
| CN | 103384036 | A | 11/2013 |
| CN | 103765685 | A | 4/2014 |
| CN | 103811886 | A | 5/2014 |
| CN | 104795654 | A | 7/2015 |
| CN | 105098413 | A | 11/2015 |
| JP | 2008270085 | A | 11/2008 |
| JP | 5805288 | B2 | 11/2015 |
| JP | 2016031842 | A | 3/2016 |

OTHER PUBLICATIONS

Taiwanese Office Action (and English language translation thereof) dated Jul. 31, 2018 issued in Taiwanese Application No. 107104707.
Chinese Office Action (and English language translation thereof) dated Mar. 14, 2019 issued in counterpart Chinese Application No. 201810071462.0.

* cited by examiner

CONNECTOR

CROSS REFERENCE TO RELATED APPLICATIONS

This application is based on and claims priority under 35 U.S.C. § 119 to Japanese Patent Application No. JP2017-036100 filed Feb. 28, 2017, the content of which is incorporated herein in its entirety by reference.

BACKGROUND OF THE INVENTION

This invention relates to a connector which is mateable with a mating connector and comprises a lock portion which maintains a mated state with the mating connector.

This type of connector is disclosed in JP 5805288B (Patent Document 1), the content of which is incorporated herein by reference.

Referring to FIGS. 24 and 25, Patent Document 1 discloses a receptacle (connector) 90 which comprises a receptacle housing (housing) 910 and two power terminals 920. The connector 90 is formed with a receptacle-side receiving space (receiving portion) 912. Each of the power terminals 920 has a lock portion 922 exposed inside the receiving portion 912. The connector 90 is mateable with a plug (mating connector) 96 which comprises two locked portions (mating lock portions) 962. Under a mated state where the connector 90 and the mating connector 96 are mated with each other, the mating connector 96 is partially received in the receiving portion 912, and the mating lock portions 962 are located inside the receiving portion 912. Under the mated state, the lock portions 922 lock the mating lock portions 962, respectively, to maintain the mated state.

As can be seen from FIG. 25, in a case where a straight upward force along an upper-lower direction (Z-direction), or a force along the positive Z-direction, is applied to the mating connector 96 under the mated state, two mating lock portions 962 are brought into abutment with the lock portions 922, respectively, to be stopped, so that the lock of the mating lock portions 962 by the lock portions 922 is kept. In other words, the mated state is maintained. However, in another case where an obliquely upward force (F) is applied to an upper end of one of opposite sides (positive X-side in FIG. 25) of the mating connector 96 in a front-rear direction (X-direction) while a lower end of a remaining one of the opposite sides (negative X-side in FIG. 25) of the mating connector 96 in the X-direction is used as a fulcrum, one of the mating lock portions 962 might be moved upward without being stopped by the lock portion 922. In other words, the mated state might be released.

SUMMARY OF THE INVENTION

It is therefore an object of the present invention to provide a connector which is mateable with a mating connector and comprises a lock portion which facilitates to more securely maintain a mated state with the mating connector.

An aspect of the present invention provides a connector mountable on an object in an upper-lower direction and mateable with a mating connector along the upper-lower direction. The mating connector has a received portion provided with two mating lock portions. The connector extends longer in a front-rear direction perpendicular to the upper-lower direction than in a lateral direction perpendicular to both the upper-lower direction and the front-rear direction. The connector comprises a housing, terminals and two additional members. The terminals and the additional members are held by the housing. The housing has an outer wall, a projecting wall and a receiving portion. The projecting wall projects upward in the upper-lower direction. The outer wall surrounds the projecting wall in a horizontal plane perpendicular to the upper-lower direction. The receiving portion is a space formed between the outer wall and the projecting wall and receives the received portion of the mating connector under a mated state where the connector is mated with the mating connector. Each of the additional members has a lock portion. The two lock portions are located at opposite sides of the projecting wall, respectively, in one of the front-rear direction and the lateral direction and face the receiving portion. Under the mated state, the lock portions lock the locked portions, respectively, to maintain the mated state.

According to an aspect of the present invention, the two lock portions are located at the opposite sides of the projecting wall, respectively, in one of the front-rear direction and the lateral direction and face the receiving portion. According to this arrangement, when an obliquely upward force is applied to the mating connector under the mated state, one of the mating lock portions receives a force toward the lock portion. Therefore, the lock of the mating lock portions by the lock portions is not unlocked so that the mated state is maintained. As described above, the lock portions according to an aspect of the present invention facilitate to more securely maintain the mated state with the mating connector.

An appreciation of the objectives of the present invention and a more complete understanding of its structure may be had by studying the following description of the preferred embodiment and by referring to the accompanying drawings.

Figure 1:
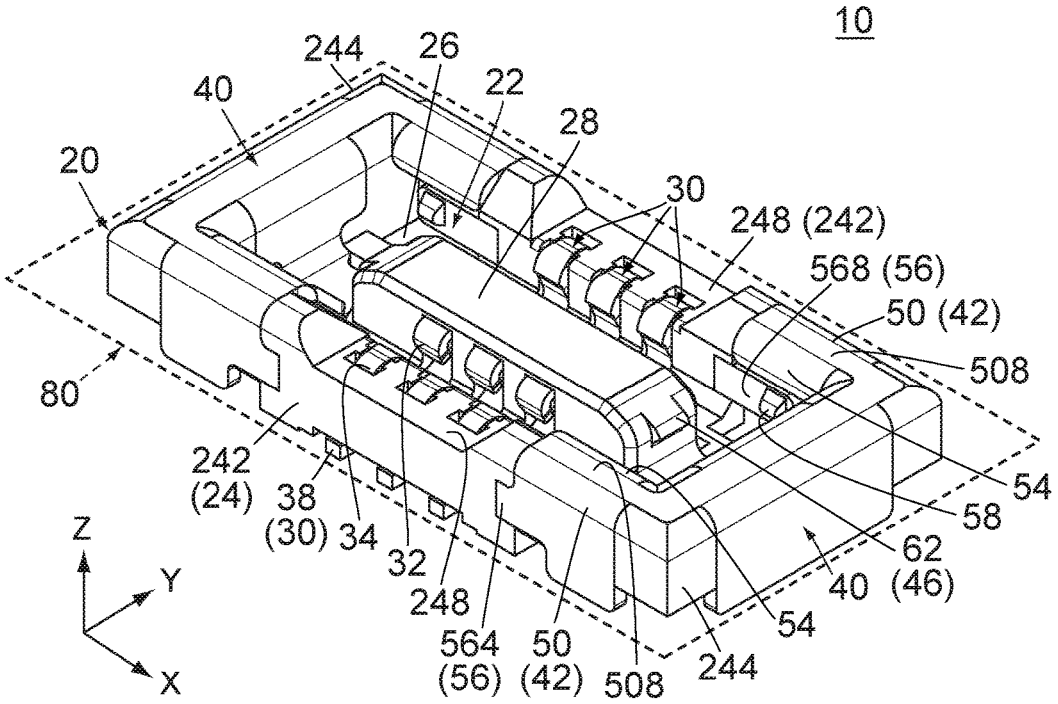
FIG. 1 is a perspective view showing a connector according to an embodiment of the present invention, wherein an outline of a circuit board on which the connector is mounted is illustrated in dashed line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 4:
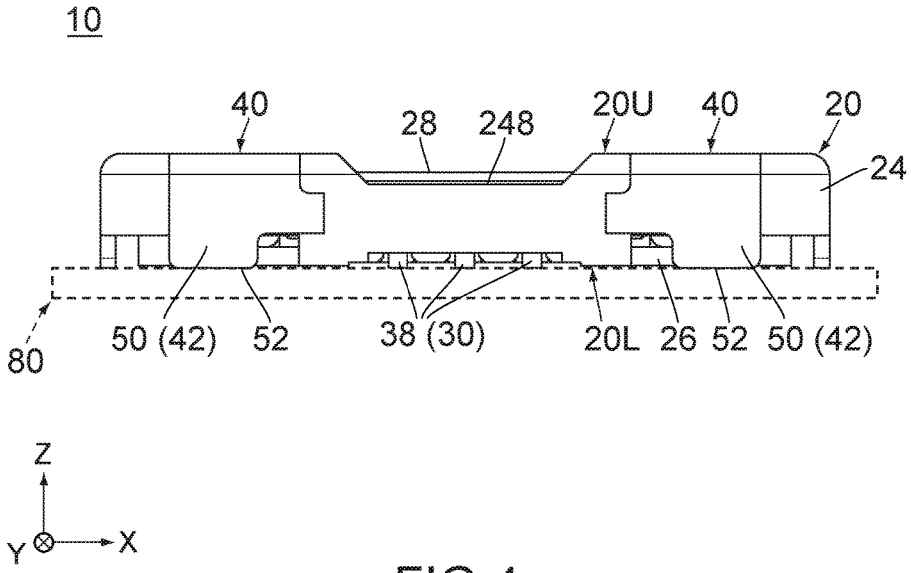
FIG. 4 is a side view showing the connector of FIG. 1, wherein an outline of the circuit board is illustrated in dashed-line.
Figure 14:
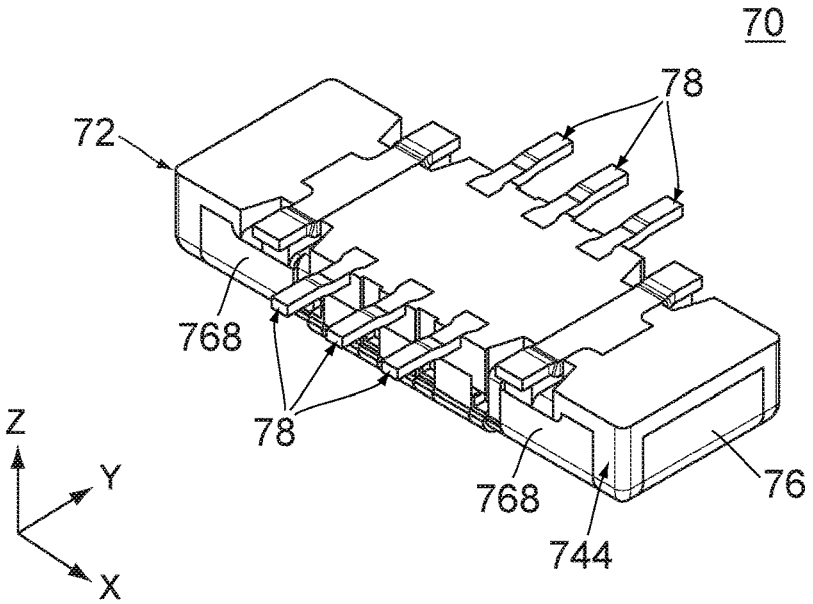
FIG. 14 is a perspective view showing the mating connector which is mateable with the connector of FIG. 1.
Figure 18:
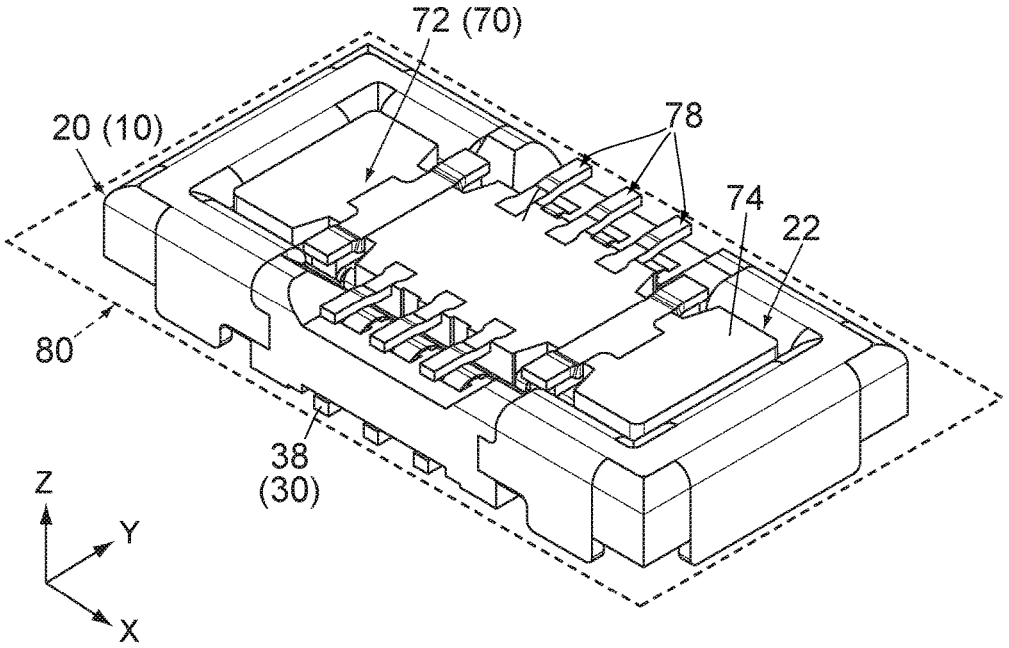
FIG. 18 is a perspective view showing the connector of FIG. 1 and the mating connector of FIG. 14, wherein the connector and the mating connector are in a mated state, and an outline of the circuit board is illustrated in dashed-line.

Referring to FIGS. 1 and 4, a connector 10 according to an embodiment of the present invention is mountable on an object (circuit board) 80 in an upper-lower direction (Z-direction). In other words, the connector 10 is an on-board connector that is mounted on the circuit board 80 when used. Referring to FIGS. 1, 14 and 18, the connector 10 is mateable with a mating connector 70 along the Z-direction (mating direction).

Referring to FIGS. 14 to 17, the mating connector 70 comprises a mating housing 72 made of insulator such as resin, two mating additional members 76 each made of bendable material such as metal and mating terminals 78 each made of conductor such as metal. Each of the mating additional members 76 is held by the mating housing 72 and partially covers the mating housing 72. Each of the mating terminals 78 is held by the mating housing 72.

Figure 15:
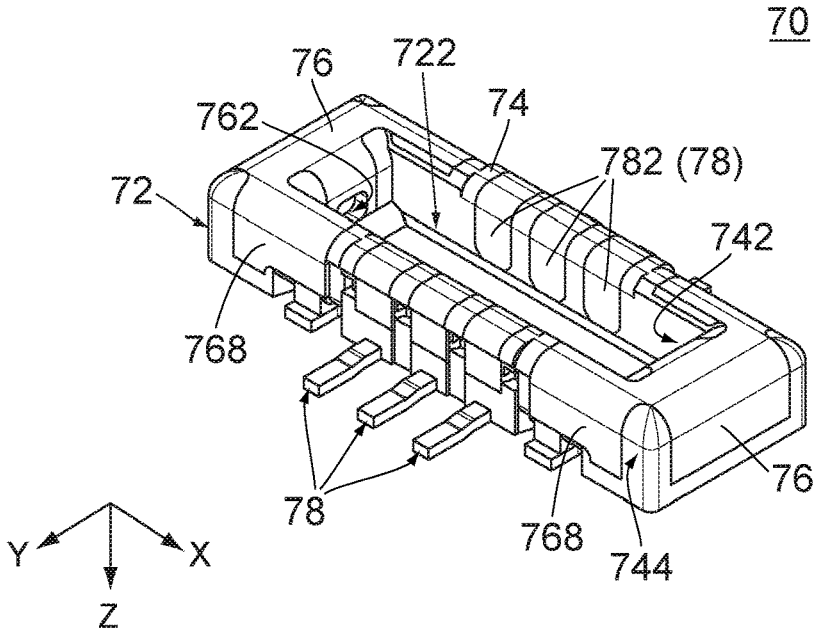
FIG. 15 is another perspective view showing the mating connector of FIG. 14.
Figure 16:
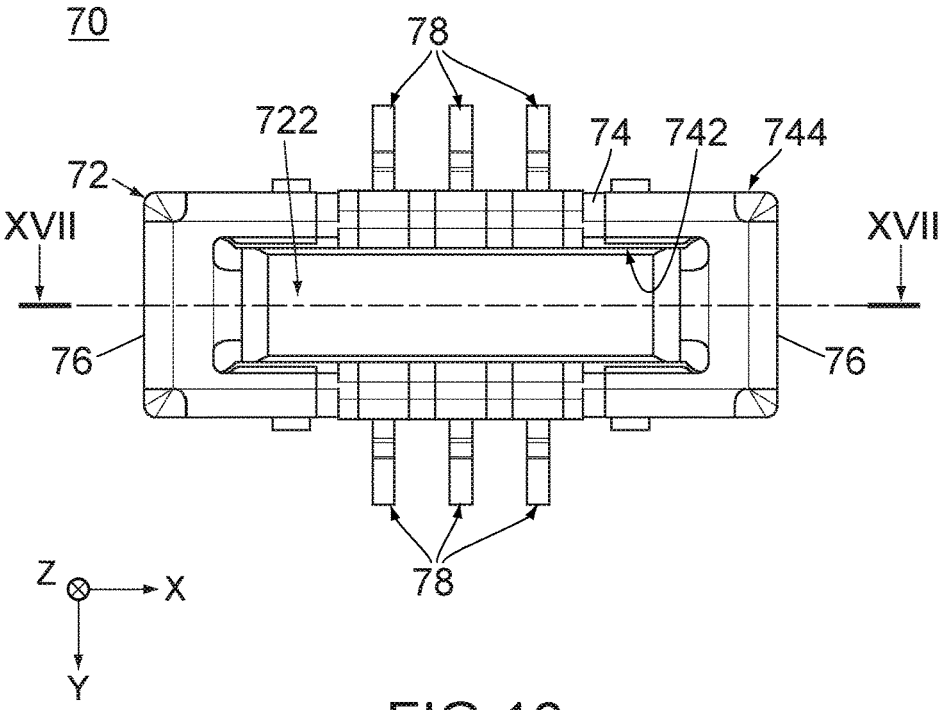
FIG. 16 is a plan view showing the mating connector of FIG. 15.
Figure 17:
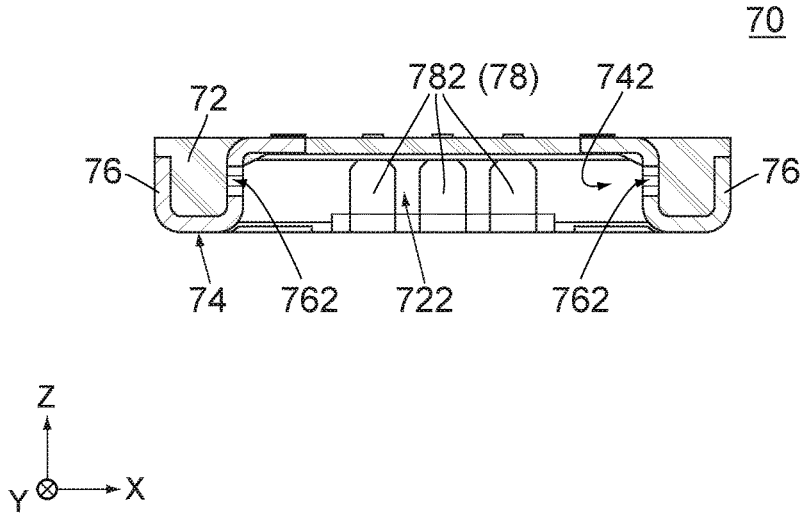
FIG. 17 is a cross-sectional view showing the mating connector of FIG. 14, taken along line XVII-XVII of FIG. 16.

As shown in FIGS. 15 to 17, the mating connector 70 has a mating receiving portion 722 and a received portion 74. The mating receiving portion 722 is a space recessed in the Z-direction and is located at the middle of the mating housing 72 in a horizontal plane (XY-plane) perpendicular to the Z-direction. The received portion 74 surrounds the mating receiving portion 722 in the XY-plane. The received portion 74 is formed with an inner wall portion 742 and an outer wall portion 744. The inner wall portion 742 faces the mating receiving portion 722, and the outer wall portion 744 faces the outside of the received portion 74.

Referring to FIGS. 14, 15 and 17, the two mating additional members 76 are located at opposite sides of the received portion 74, respectively, in a front-rear direction (X-direction) perpendicular to the upper-lower direction (Z-direction). Each of the mating additional members 76 has a mating lock portion 762 and two mating contact points 768. Each of the mating lock portions 762 is a hole formed in the mating additional member 76. The two mating lock portions 762 are located at opposite sides of the inner wall portion 742 in the X-direction, respectively, and face the mating receiving portion 722. In each of the mating additional members 76, the two mating contact points 768 are located at opposite sides of the outer wall portion 744, respectively, in a lateral direction (Y-direction) perpendicular to both the upper-lower direction (Z-direction) and the front-rear direction (X-direction), and each of the mating contact points 768 is exposed outside the received portion 74 in the Y-direction. Thus, the mating connector 70 has the received portion 74 provided with the two mating lock portions 762 and the four mating contact points 768.

Referring to FIGS. 14 to 17, the mating terminals 78 are grouped into two rows each extending along the X-direction. Each of the mating terminals 78 in each row has a mating contact portion 782. Two rows of the mating contact portions 782 are located at opposite sides of the inner wall portion 742 in the Y-direction and face the mating receiving portion 722.

Referring to FIGS. 1 to 5, the connector 10 comprises a housing 20 made of insulator such as resin, terminals 30 each made of conductor such as metal and two additional members 40 each made of bendable material such as metal.

Figure 3:
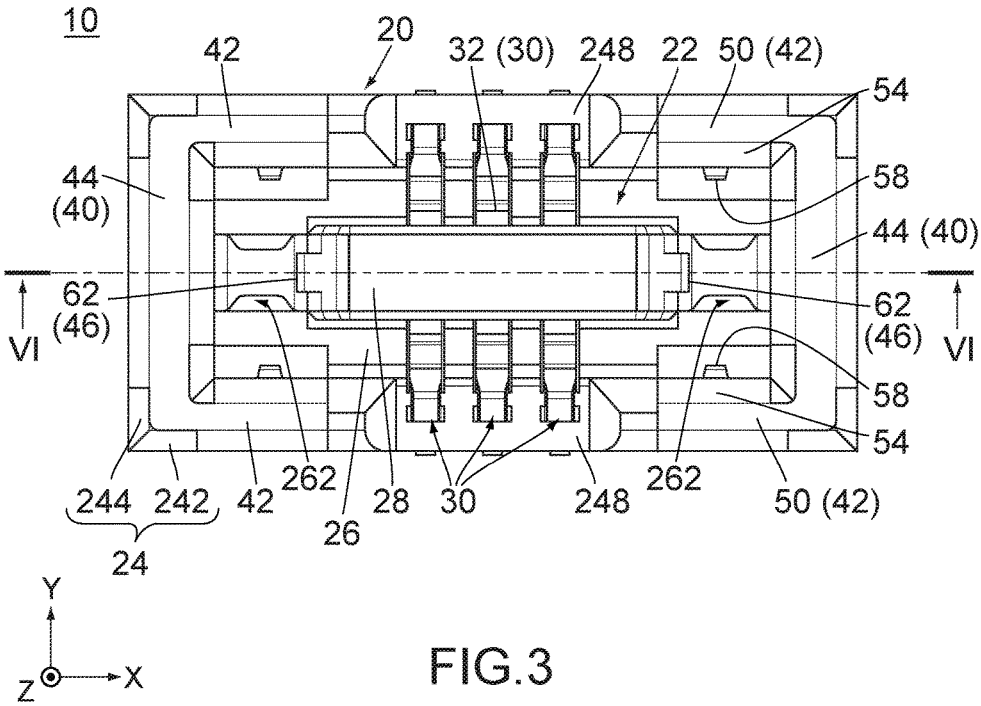
FIG. 3 is a top view showing the connector of FIG. 1.

As shown in FIGS. 1 and 3, the housing 20 has an outer wall 24. The outer wall 24 has a rectangular frame-shape in the XY-plane. In detail, the outer wall 24 has two sidewalls 242 and two coupling walls 244. Each of the sidewalls 242 extends along the X-direction to have a front end (positive X-side end) and a rear end (negative X-side end) in the X-direction. Each of the sidewalls 242 has a holding portion 248 for holding the terminals 30. The holding portion 248 is formed at the middle of the sidewall 242 in the X-direction. Each of the coupling walls 244 extends along the Y-direction and couples the front ends or the rear ends of the two sidewalls 242 to each other in the Y-direction. A size of the sidewall 242 in the X-direction is larger than a size of the coupling wall 244 in the Y-direction. Therefore, the connector 10 extends longer in the X-direction than in the Y-direction.

The housing 20 has a receiving portion 22, a bottom wall 26 and a projecting wall 28. The bottom wall 26 is located at a lower end, or the negative Z-side end, of the housing 20 in the Z-direction. The projecting wall 28 projects upward in the Z-direction, or projects in the positive Z-direction, from the bottom wall 26. The projecting wall 28 is located at the middle of the housing 20 in the XY-plane and surrounded by the outer wall 24 in the XY-plane. The receiving portion 22 is a space formed between the outer wall 24 and the projecting wall 28.

Figure 2:
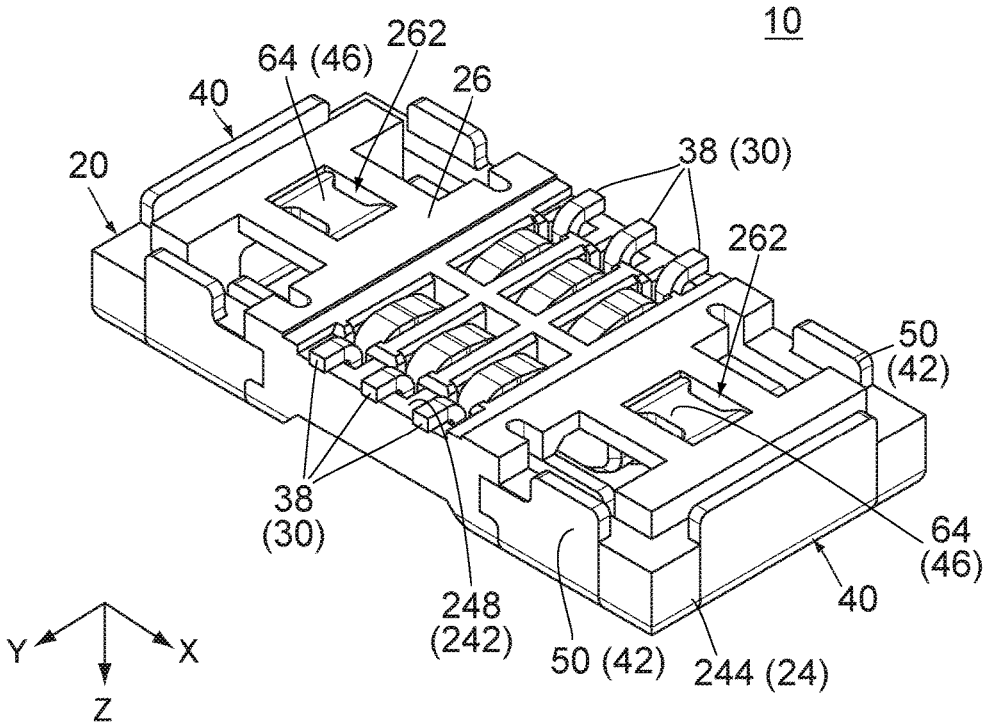
FIG. 2 is another perspective view showing the connector of FIG. 1.
Figure 5:
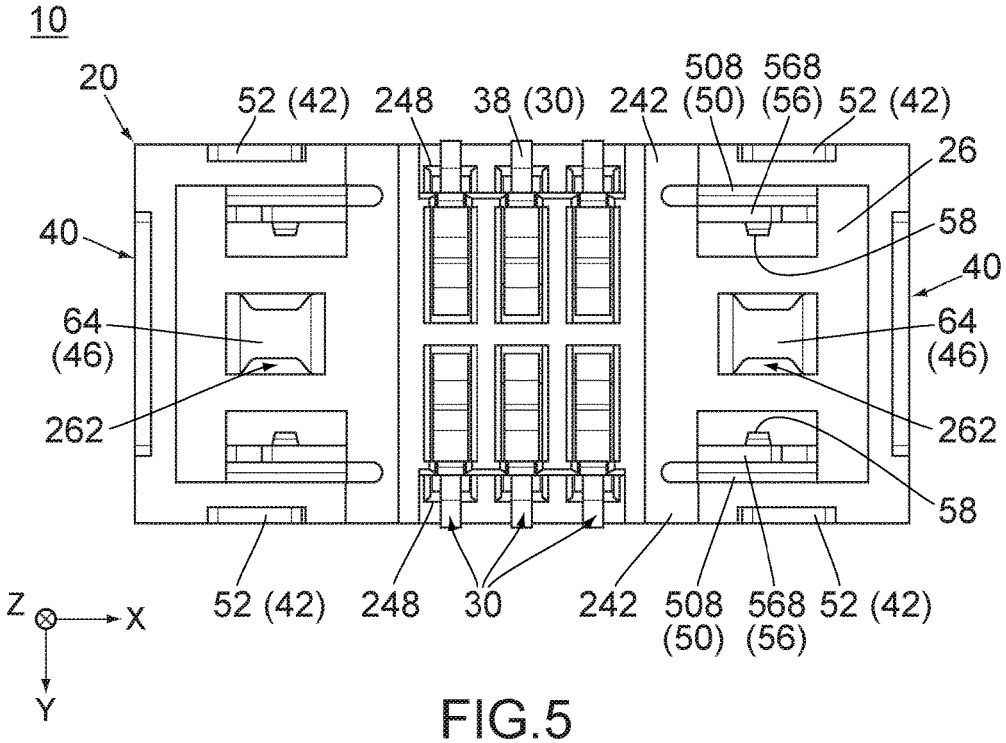
FIG. 5 is a bottom view showing the connector of FIG. 1.

As shown in FIGS. 2, 3 and 5, the bottom wall 26 of the housing 20 is formed with two bottom holes 262. Each of the bottom holes 262 is located under the receiving portion 22 and passes through the bottom wall 26 in the Z-direction. Thus, the receiving portion 22 opens downward, or in the negative Z-direction, via the bottom holes 262 of the housing 20.

Referring to FIG. 4, the housing 20, which is formed as described above, has an upper surface 20U and a lower surface 20L. The upper surface 20U is located at an upper end, or the positive Z-side end, of the connector 10, and the lower surface 20L is located at a lower end of the connector 10. In the present embodiment, the upper surface 20U is an upper surface of the outer wall 24, and the lower surface 20L is a lower surface of the bottom wall 26.

Referring to FIGS. 1 and 2, the terminals 30 according to the present embodiment are grouped into two rows each extending along the X-direction. Each of the terminals 30 in each row is a signal terminal and has a contact portion 32, a held portion 34 and a fixed portion 38. Each of the terminals 30 is held by the housing 20. In detail, two rows of the held portions 34 are held by the holding portions 248 of the two sidewalls 242, respectively. As can be seen from FIGS. 1 to 3, in each of the terminals 30, the contact portion 32 extends from the held portion 34 to the inside of the projecting wall 28 and subsequently extends upward while partially projecting to the inside of the receiving portion 22. In each of the terminals 30, the fixed portion 38 extends outward in the Y-direction from a lower end of the held portion 34.

Figure 19:
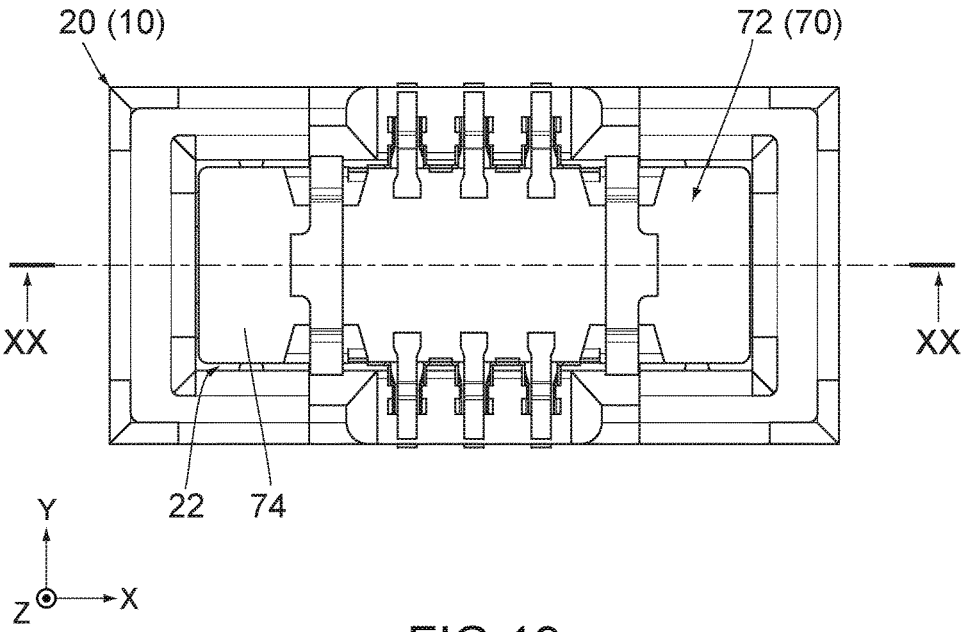
FIG. 19 is a top view showing the connector and the mating connector of FIG. 18.
Figure 20:
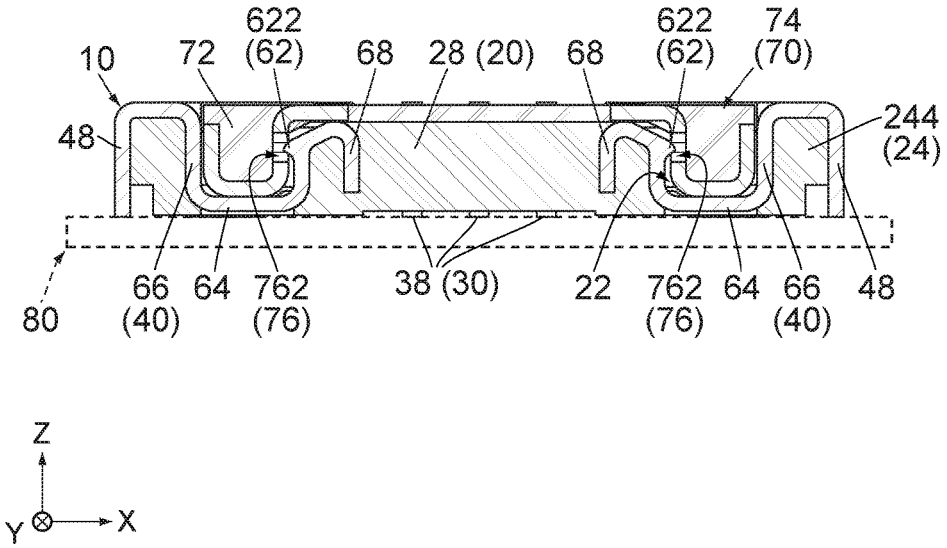
FIG. 20 is a cross-sectional view showing the connector and the mating connector of FIG. 19, taken along line XX-XX, wherein an outline of the circuit board is illustrated in dashed-line.

Referring to FIG. 4, when the connector 10 is used, each of the fixed portions 38 is fixed to and electrically connected with the circuit board 80 via soldering, etc. Referring to FIGS. 18 to 20, under a mated state where the connector 10 is mated with the mating connector 70, the receiving portion 22 of the connector 10 receives the received portion 74 of the mating connector 70. As can be seen from FIGS. 1 and 15, under the mated state, the mating receiving portion 722 of the mating connector 70 receives the projecting wall 28 of the connector 10, and the contact portions 32 of the terminals 30 are brought into contact with the mating contact portions 782 of the mating terminals 78, respectively. As a result, the connector 10 and the mating connector 70 are electrically connected with each other so that the mating connector 70 is electrically connected with the circuit board 80.

Referring to FIG. 1, the housing 20 and the terminals 30 of the connector 10 are not limited to the aforementioned embodiment but can be variously modified. For example, the housing 20 may have any shape, provided that the housing 20 has the receiving portion 22, the outer wall 24 and the projecting wall 28. The portion of the housing 20 that holds the terminals 30 is not limited to the holding portion 248 of the outer wall 24. Moreover, each of the terminals 30 does not need to be a signal terminal.

Hereafter, explanation will be made in detail about the additional members 40 of the connector 10.

Referring to FIGS. 1 to 6, the two additional members 40 have shapes and sizes same as each other. Each of the additional members 40 is held by the housing 20. The additional members 40 are apart from each other in the X-direction and arranged in mirror symmetry with respect to the YZ-plane. However, the present invention is not limited thereto. For example, each of the two additional members 40 may be a part of a common single member that is integrally formed. Instead, each of the additional members 40 may be formed of a plurality of members which are joined together. Moreover, the connector 10 may be provided with three or more of the additional members 40 separated from one another, and the additional members 40 may have shapes different from one another to some extent. However, from the viewpoint of reducing manufacturing cost, the additional members 40 are preferred to have shapes and sizes same as one another.

Referring to FIGS. 7 to 12, each of the additional members 40 according to the present embodiment is a single metal plate with bends and has a mirror-symmetrical shape with respect to the XZ-plane. In detail, each of the additional members 40 has two side portions 42, a coupling portion 44, a body portion 46 and an outer protection portion 48. The two side portions 42 are apart from each other in the Y-direction and have shapes mirror-symmetrical to each other with respect to the XZ-plane. The coupling portion 44 extends along the Y-direction as a whole.

Hereafter, explanation will be made about the body portion 46 and the outer protection portion 48 of each of the additional members 40.

Figure 6:
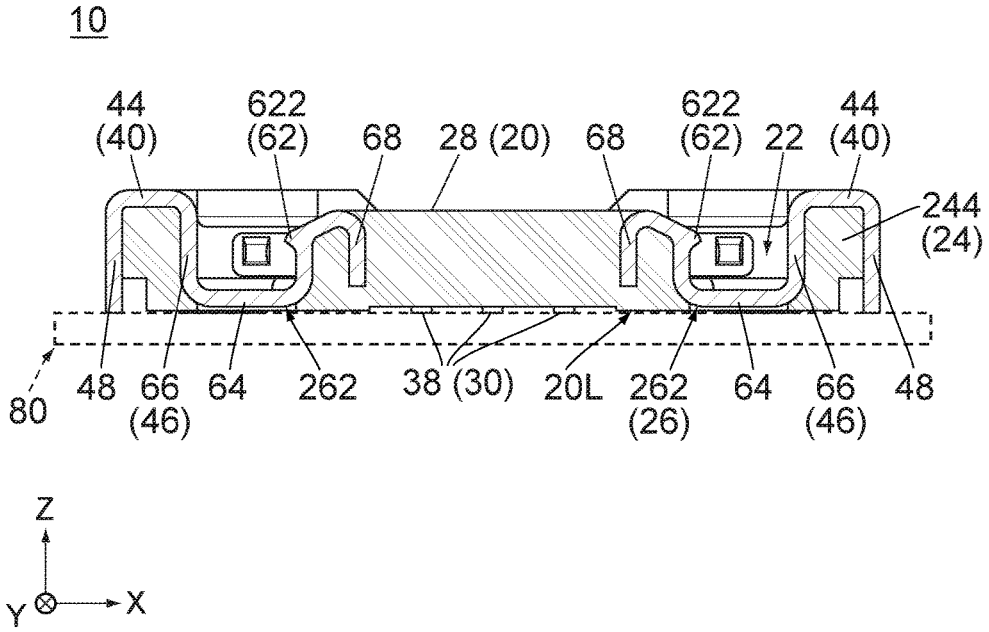
FIG. 6 is a cross-sectional view showing the connector of FIG. 3, taken along line VI-VI, wherein an outline of the circuit board is illustrated in dashed-line.
Figure 7:
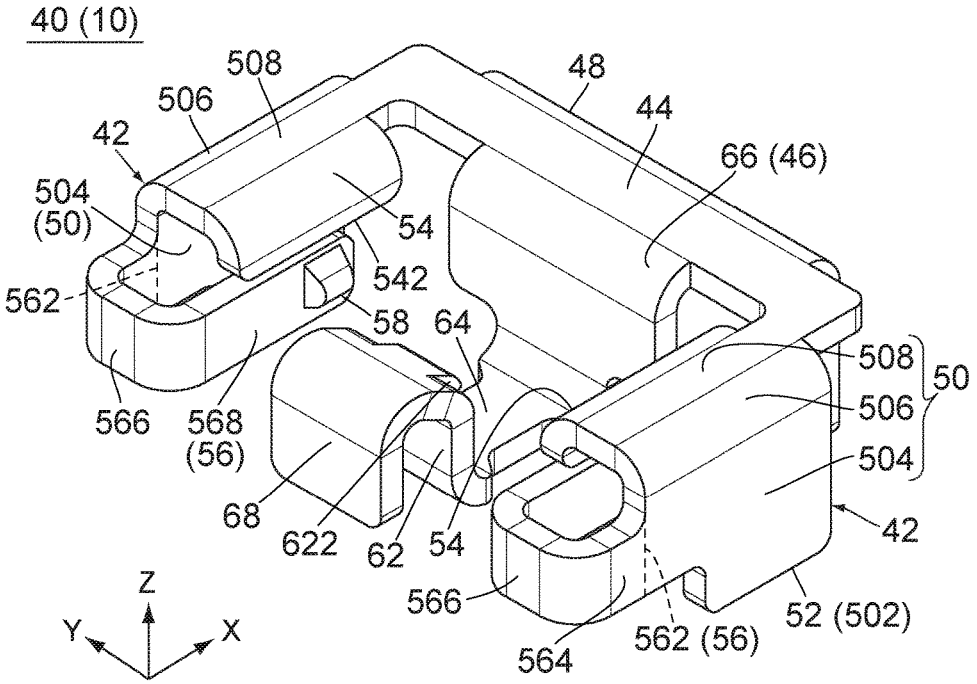
FIG. 7 is a perspective view showing an additional member of the connector of FIG. 1, wherein a position of a starting portion of each of spring portions is illustrated in dashed-line.

Referring to FIG. 6 together with FIG. 7, in the front additional member 40, or in the additional member 40 that is located at a front side (positive X-side) of the connector 10, the body portion 46 extends rearward, or in the negative X-direction, as a whole from the middle of the coupling portion 44 in the Y-direction, and the outer protection portion 48 is bent to extend forward, or in the positive X-direction, and downward from the middle of the coupling portion 44 in the Y-direction and subsequently extends downward. In the rear additional member 40, or the additional member 40 that is located at a rear side (negative X-side) of the connector 10, the body portion 46 extends forward as a whole from the middle of the coupling portion 44 in the Y-direction, and the outer protection portion 48 is bent to extend rearward and downward from the middle of the coupling portion 44 in the Y-direction and subsequently extends downward. In other words, in each of the additional members 40, the body portion 46 extends inward in the X-direction from the coupling portion 44, and the outer protection portion 48 extends outward in the X-direction from the coupling portion 44.

Referring to FIGS. 7 to 10, the body portion 46 of each of the two additional members 40 has a lock portion 62, a fixed portion 64, an inner protection portion 66 and a held portion 68 and is connected to the coupling portion 44 at an outer end of the inner protection portion 66 in the X-direction. The inner protection portion 66 is bent to extend inward in the X-direction and downward from the middle of the coupling portion 44 in the Y-direction and subsequently extends downward. The fixed portion 64 extends inward in the X-direction from a lower end of the inner protection portion 66. The lock portion 62 extends upward from an inner end of the fixed portion 64 in the X-direction. The held portion 68 is bent to extend inward in the X-direction and upward from an upper end of the lock portion 62 and subsequently extends downward.

Figure 8:
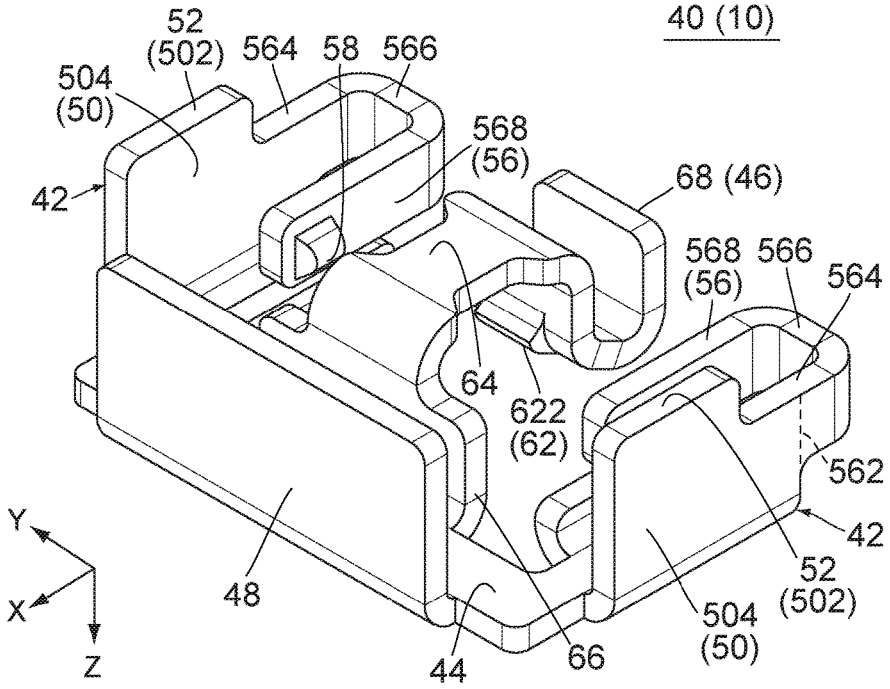
FIG. 8 is another perspective view showing the additional member of FIG. 7, wherein the position of the starting portion of the spring portion is illustrated in dashed-line.
Figure 9:
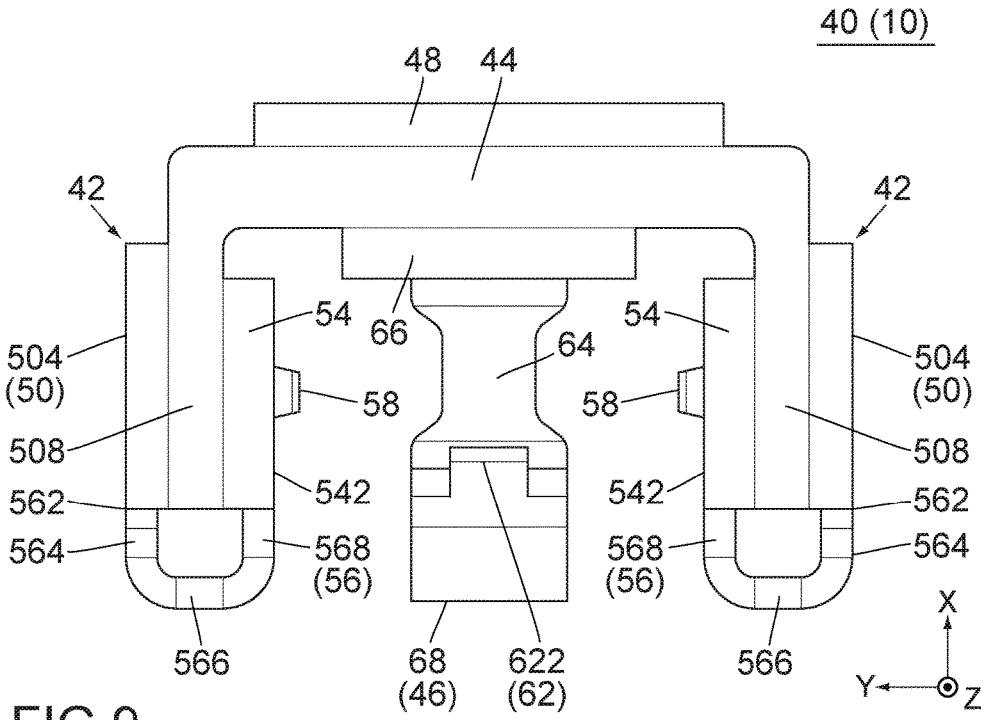
FIG. 9 is a top view showing the additional member of FIG. 7.
Figure 10:
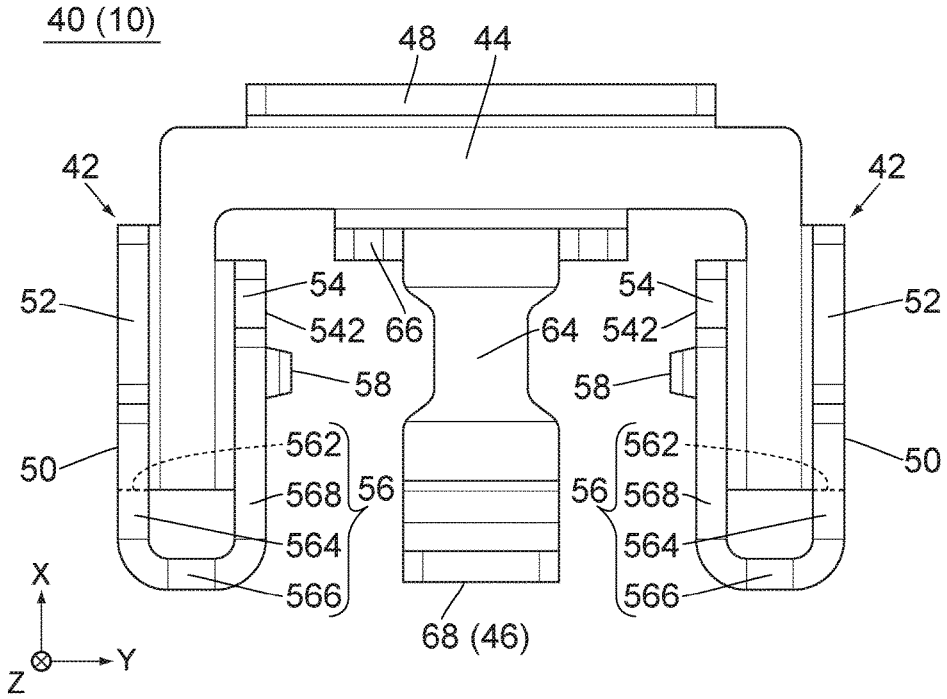
FIG. 10 is a bottom view showing the additional member of FIG. 7, wherein the position of the starting portion of each of the spring portions is illustrated in dashed-line.
Figure 13:
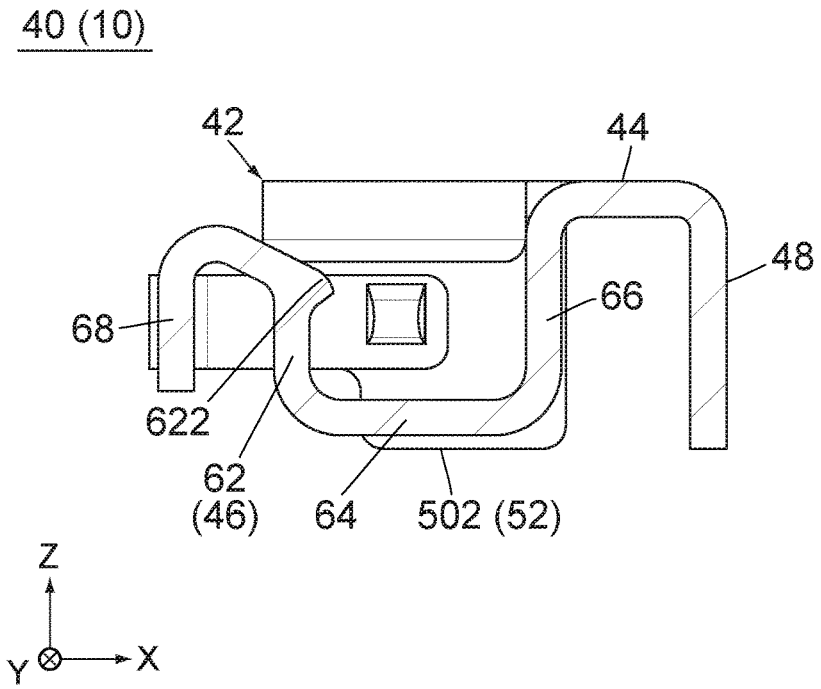
FIG. 13 is a cross-sectional view showing the additional member of FIG. 7, taken along line XIII-XIII of FIG. 12.

As shown in FIGS. 7 to 9, the lock portion 62 has a projection 622. As shown in FIG. 13, the projection 622 is located at an upper end of the lock portion 62 and projects outward in the X-direction. As shown in FIG. 6, the lock portions 62 of the two additional members 40 are located at opposite sides of the projecting wall 28 in the X-direction, respectively, and face the receiving portion 22. Each of the projections 622 projects into and is exposed inside the receiving portion 22. The thus-formed two projections 622 project to be away from each other in the X-direction.

The fixed portion 64 of each of the additional members 40 extends outward in the X-direction from a lower end of the lock portion 62. The thus-formed fixed portion 64 of each of the additional members 40 couples the lower end of the inner protection portion 66 and the lower end of the lock portion 62 to each other.

Referring to FIGS. 2, 5 and 6, in the present embodiment, the two fixed portions 64 are located inside the two bottom holes 262 of the bottom wall 26 of the housing 20, respectively. Each of the fixed portions 64 is located above the lower surface 20L of the housing 20, or the lower end of the connector 10, with a slight gap. Each of the fixed portions 64, which is arranged as described above, is fixed to the circuit board 80 via soldering, etc., when the connector 10 is used. However, the present invention is not limited thereto. For example, each of the fixed portions 64 may be located inside the common bottom hole 262 that is formed in the bottom wall 26 of the housing 20 and continuously extends. In other words, the housing 20 may be formed with one or more of the bottom holes 262, and the fixed portion 64 of each of the additional members 40 may be located inside one of the bottom holes 262. Moreover, each of the fixed portions 64 may have a lower end that is located at a position same as that of the lower surface 20L of the housing 20 in the Z-direction.

Referring to FIG. 6, the held portion 68 of each of the additional members 40 is held by the projecting wall 28. More specifically, in the present embodiment, the additional members 40 are embedded in the housing 20 via insert-molding, and the held portions 68 of the body portions 46 are embedded in the projecting wall 28. In addition, the coupling portions 44 are embedded in upper ends of the coupling walls 244 of the outer wall 24, respectively. In each of the additional members 40, the inner protection portion 66 of the body portion 46 and the outer protection portion 48 are embedded in the coupling wall 244 so as to interpose the coupling wall 244 in the X-direction. However, the present invention is not limited thereto. For example, the held portion 68, etc. of each of the additional members 40 may be press-fit in the housing 20.

Referring to FIG. 20, under the mated state, the two mating lock portions 762 are received in the receiving portion 22 and face the two lock portions 62 in the X-direction, respectively, so that the lock portions 62 lock the mating lock portions 762, respectively, to maintain the mated state. According to the present embodiment, under the mated state, the projections 622 of the lock portions 62 are inserted into the insides of the mating lock portions 762, respectively, so that the mating lock portions 762 are locked. However, the present invention is not limited thereto. For example, each of the lock portions 62 may have, instead of the projection 622, a depression that is exposed inside the receiving portion 22. In this structure, each of the mating lock portions 762 may be a projection that projects inward in the X-direction. In other words, the mating lock portions 762 may be inserted into the insides of the depressions of the lock portion 62, respectively, so as to be locked.

According to the present embodiment, the two lock portions 62 are located at the opposite sides of the projecting wall 28 in the X-direction, respectively, and the thus-located lock portions 62 lock the mating lock portions 762, respectively. According to this arrangement, when an obliquely upward force, or a force that has both a force component in the X-direction and another force component in the Z-direction, is applied to the mating connector 70 under the mated state, one of the mating lock portions 762 receives a force toward the lock portion 62. Therefore, the lock of the mating lock portions 762 by the lock portions 62 is not unlocked so that the mated state is maintained. As described above, the lock portions 62 according to the present embodiment facilitate to more securely maintain the mated state with the mating connector 70.

The arrangement of the lock portions 62 according to the present invention is not limited to the aforementioned embodiment but can be variously modified. For example, the two lock portions 62 may be located at opposite sides of the projecting wall 28 in the Y-direction, respectively. Thus, the two lock portions 62 may be located at the opposite sides of the projecting wall 28, respectively, in one of the X-direction and the Y-direction. The two lock portions 62 may be or may not be located at positions same as each other in the Y-direction when being located at the opposite sides of the projecting wall 28 in the X-direction, respectively. Similarly, the two lock portions 62 may be or may not be located at positions same as each other in the X-direction when being located at the opposite sides of the projecting wall 28 in the Y-direction, respectively.

Moreover, the connector 10 may be provided with three or more of the lock portions 62. In this structure, one of the additional members 40 may have two or more of the lock portions 62, or the connector 10 may be provided with three or more of the additional members 40 each of which has only one of the lock portions 62. For example, when the connector 10 is provided with four of the lock portions 62, two of the lock portions 62 may be located at the opposite sides of the projecting wall 28 in the X-direction, respectively, and remaining two of the lock portions 62 may be located at the opposite sides of the projecting wall 28 in the Y-direction, respectively.

According to the present embodiment, when the connector 10 is used, the fixed portions 64 are fixed to the circuit board 80, and the held portions 68 are fixed to and held by the projecting wall 28. Each of the lock portions 62 is located between the fixed portion 64 and the held portion 68 which are fixed as described above, so that each of the lock portions 62 is hardly moved even when receiving a strong force. Therefore, the lock portions 62 facilitate to securely lock the mating lock portions 762. However, the present invention is not limited thereto. For example, each of the body portions 46 may have only one or none of the fixed portion 64 and the held portion 68.

According to the present embodiment, the inner protection portion 66 of each of the additional members 40 extends upward from the fixed portion 64 and partially covers the outer wall 24. In particular, the inner protection portions 66 cover inner surfaces of the coupling walls 244 in the X-direction, respectively, so as to prevent the coupling walls 244 from being damaged by the mating connector 70. However, the present invention is not limited thereto. For example, each of the body portions 46 may have the inner protection portion 66 as necessary. For example, each of the body portions 46 may have the outer protection portion 48 as a part thereof instead of the inner protection portion 66. In this structure, each of the body portions 46 may have a portion that passes under the coupling wall 244 and couples a lower end of the outer protection portion 48 to an outer end of the fixed portion 64 in the X-direction.

Hereafter, explanation will be made about the side portions 42 of the front additional member 40 of the connector 10. As described above, the two additional members 40 are the same components as each other while being arranged in mirror symmetry with respect to the YZ-plane. Therefore, the following explanation about the front additional member 40 is applicable, by reversing the situation in the X-direction, to the side portions 42 of the rear additional member 40.

Referring to FIGS. 7 to 10, the coupling portion 44 has opposite ends in the Y-direction which extend rearward to be connected to the two side portions 42, respectively. In other words, the coupling portion 44 couples the two side portions 42 to each other. Referring to FIG. 1, the two side portions 42 are partially embedded in the two sidewalls 242, respectively. The thus-embedded two side portions 42 are located across the receiving portion 22 in the Y-direction.

As shown in FIGS. 7 to 12, each of the side portions 42 has a base portion 50, an anchored portion 52, an armor portion 54, a spring portion 56 and a projecting portion 58. Thus, the additional member 40 has the two base portions 50, the two anchored portions 52, the two armor portions 54, the two spring portions 56 and the two projecting portions 58. As shown in FIGS. 7 and 9, the coupling portion 44 of the present embodiment couples the base portions 50 of the two side portions 42 to each other. However, the present invention is not limited thereto. For example, the coupling portion 44 may couple the armor portions 54 of the two side portions 42 to each other.

Figure 11:
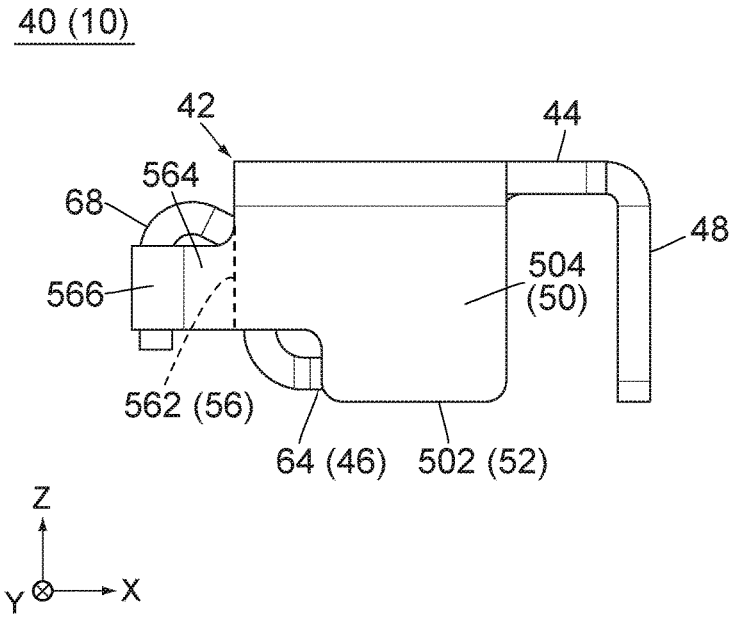
FIG. 11 is a side view showing the additional member of FIG. 7, wherein the position of the starting portion of the spring portion is illustrated in dashed-line.

Referring to FIGS. 7, 8 and 11, the anchored portion 52 of the present embodiment is a lower surface of the side portion 42 and extends along the X-direction. Referring to FIG. 4, in the Z-direction, the anchored portion 52 is located at a position same as that of the lower surface 20L of the housing 20, or the lower end of the connector 10. When the connector 10 is used, the anchored portion 52 is fixed to and electrically connected with the circuit board 80 via soldering, etc.

Referring to FIGS. 7, 8, 11 and 12, the base portion 50 extends upward as a whole from the anchored portion 52. In the present embodiment, the anchored portion 52 itself is a boundary portion 502 between the base portion 50 and the anchored portion 52. The base portion 50 according to the present embodiment has a flat-plate portion 504, a bent portion 506 and an upper plate 508. The flat-plate portion 504 has a flat-plate shape in parallel to the XZ-plane and extends straight upward from the anchored portion 52. The flat-plate portion 504 has an upper part, or the positive Z-side part, which protrudes rearward. The bent portion 506 is bent to extend upward and inward in the Y-direction from an upper end of the flat-plate portion 504. The upper plate 508 has a flat-plate shape in parallel to the XY-plane and extends inward in the Y-direction from the bent portion 506.

Figure 12:
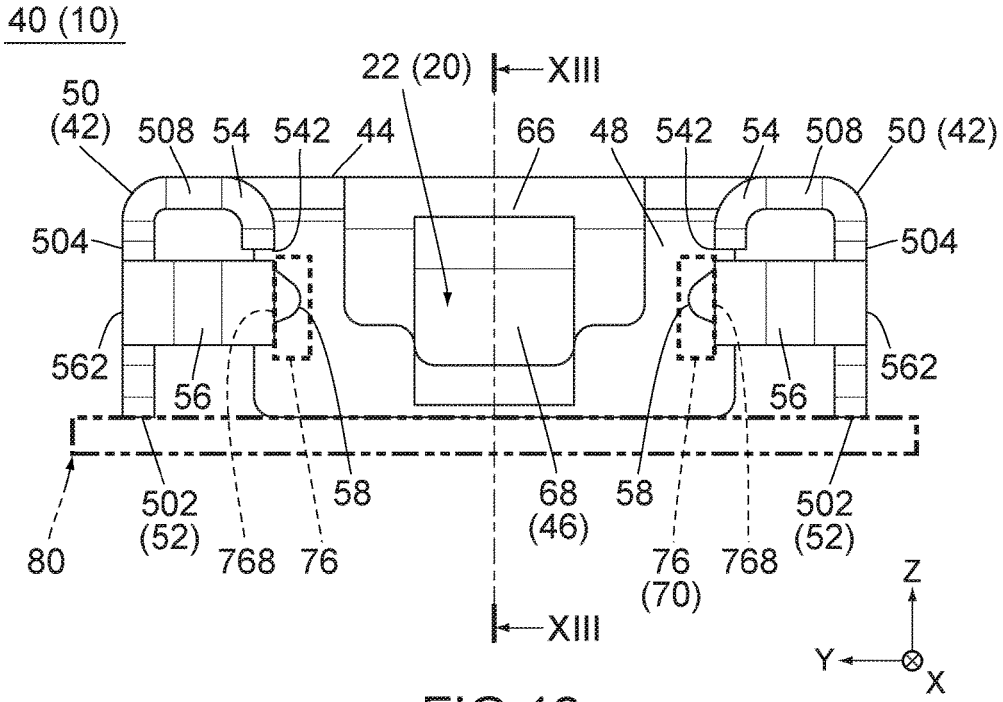
FIG. 12 is a rear view showing the additional member of FIG. 7, wherein an outline of each of mating additional members of a mating connector is illustrated in dashed-line, and another outline of the circuit board is illustrated in two-dot chain line.

Referring to FIGS. 7, 9 and 12, the armor portion 54 extends inward in the Y-direction from an inner end of the upper plate 508 of the base portion 50 in the Y-direction. In detail, as shown in FIG. 12, the armor portion 54 is bent to extend downward and inward in the Y-direction. In other words, the armor portion 54 extends toward the receiving portion 22 of the housing 20. The thus-extending armor portion 54 has an innermost portion 542. The innermost portion 542 is a part of the armor portion 54 that is located to be innermost in the Y-direction.

In the present embodiment, the innermost portion 542 of the armor portion 54 is an end of the armor portion 54. However, the present invention is not limited thereto. For example, the armor portion 54 may have another end which is bent to extend toward the flat-plate portion 504 of the base portion 50. In this structure, the innermost portion 542 of the armor portion 54 is located inward in the Y-direction relative to the end of the armor portion 54.

Referring to FIGS. 7 to 10, the spring portion 56 extends from the base portion 50 and is supported by the base portion 50 to be resiliently deformable. In other words, the spring portion 56 is resiliently deformable relative to a support point, or a boundary portion (starting portion) 562 between the spring portion 56 and the base portion 50.

The spring portion 56 according to the present embodiment has a first spring 564, a second spring 566 and a third spring 568 in addition to the starting portion 562. The first spring 564 extends rearward along the X-direction from the starting portion 562. The second spring 566 is bent to extend rearward and inward in the Y-direction from a rear end of the first spring 564, subsequently extends inward in the Y-direction, and is subsequently bent to extend forward and inward in the Y-direction. The third spring 568 starts from a front end of an inner part of the second spring 566 in the Y-direction and extends forward along the X-direction while passing under the armor portion 54.

The spring portion 56 according to the present embodiment has a J-like shape in the XY-plane and has high spring properties because of the structure described above. In particular, the third spring 568 extends long along the X-direction to have high spring properties. However, the present invention is not limited thereto, but the structure of the spring portion 56 can be variously modified. For example, the position of the starting portion 562 in the X-direction may be shifted forward so that the first spring 564 has a length almost equal to another length of the third spring 568. According to this modification, the spring portion 56 has a U-like shape in the XY-plane.

Referring to FIGS. 7 to 10, the projecting portion 58 is supported by the spring portion 56. In detail, the projecting portion 58 is formed in the vicinity of a front end of the third spring 568 of the spring portion 56 and projects inward in the Y-direction.

Referring to FIG. 9, when the side portion 42 of the additional member 40 is seen from above along the Z-direction, the third spring 568 of the spring portion 56 is partially covered by the armor portion 54. In particular, the third spring 568 according to the present embodiment has a part that is located at a position same as that of the armor portion 54 in the X-direction and that is entirely covered by the armor portion 54. However, the present invention is not limited thereto, but the spring portion 56 may be, at least in part, covered by the armor portion 54. For example, the armor portion 54 may be formed to extend rearward to entirely cover the third spring 568 of the spring portion 56. Moreover, the spring portion 56 may be formed to extend inward in the Y-direction from the middle of the base portion 50 in the X-direction so that the spring portion 56 is entirely covered by the armor portion 54.

Referring to FIGS. 1 and 5, the base portion 50 is embedded in the sidewall 242 of the housing 20 except a part of the upper plate 508 and a part in the vicinity of a lower end thereof so that the base portion 50 is fixed to the housing 20. In addition, the first spring 564 and the second spring 566 (see FIG. 7) of the spring portion 56 are embedded in the sidewall 242 to be fixed to the housing 20. In contrast, the third spring 568 of the spring portion 56 is located in a space formed in the sidewall 242 and is movable relative to the housing 20. The projecting portion 58 supported by the third spring 568 is movable in the Y-direction.

As described above, the first spring 564 and the second spring 566 (see FIG. 7) of the present embodiment are embedded in the housing 20 and unmovable relative to the housing 20. However, the present invention is not limited thereto. One or both of the first spring 564 and the second spring 566 may have no part embedded in the housing 20 to be movable relative to the housing 20.

Referring to FIGS. 1 and 3, the base portion 50 is located outside the receiving portion 22 in the Y-direction. Moreover, when the additional member 40 is seen from above along the Z-direction under an unmated state where the connector 10 is not mated with the mating connector 70 (see FIG. 14), the projecting portion 58 is located in the receiving portion 22 to be visible. The thus-arranged projecting portion 58 is pressed against and brought into contact with the mating connector 70 under the mated state.

Referring to FIG. 12, the projecting portion 58 of the present embodiment is brought into contact with the mating contact point 768 of the mating connector 70 under the mated state. In the present embodiment, the additional member 40 is a power terminal of the connector 10, and the mating additional member 76 is a power terminal of the mating connector 70. Thus, each of the projecting portion 58 and the mating contact point 768 is a contact portion of the power terminal, and the projecting portion 58 and the mating contact point 768 are electrically connected with each other under the mated state. However, the present invention is not limited thereto, but each of the projecting portion 58 and the mating contact point 768 does not need to be a power terminal. In any usage of the additional member 40, the connector 10 of the present embodiment is connected to the mating connector 70 at the projecting portion 58 supported by the spring portion 56.

According to the present embodiment, the projecting portion 58 is entirely located in the receiving portion 22 to be visible. However, the present invention is not limited thereto, but the projecting portion 58 may be, at least in part, located in the receiving portion 22 to be visible.

Referring to FIGS. 1 and 3, according to the present embodiment, each of the side portions 42 of the additional member 40 is provided with the armor portion 54 which is bent to extend downward. As previously described, the armor portion 54 covers the third spring 568 (see FIG. 7), which is movable relative to the housing 20, from above. Therefore, during the mating process of the connector 10 with the mating connector 70, the mating connector 70 is guided by the armor portion 54 to be smoothly moved downward without deforming the third spring 568 prior to the contact of the mating connector 70 with the projecting portion 58.

Referring to FIG. 1, in each of the side portions 42 of the additional member 40, all of the parts except the armor portion 54 and the third spring 568 are fixed to the housing 20, so that only the armor portion 54 and the third spring 568 are movable relative to the housing 20. In addition, the armor portion 54 and the third spring 568 are not directly connected to each other. Therefore, even if the mating connector 70 (see FIG. 14) is brought into abutment with the armor portion 54 in the mating process of the connector 10 with the mating connector 70 so that the armor portion 54 receives a relatively small pushing force that resiliently deforms the armor portion 54, the third spring 568 is unaffected by this pushing force. In other words, the projecting portion 58 supported by the third spring 568 is not moved by this pushing force but is brought into contact with the mating contact point 768 (see FIG. 14) as designed.

Referring to FIG. 12, the pushing force of the mating connector 70, which is applied to the armor portion 54 of the additional member 40, is received by the circuit board 80 via the base portion 50 and the anchored portion 52. Therefore, even in a case where the pushing force is so large that the armor portion 54 is plastically deformed, a part of the additional member 40 that is close to the anchored portion 52 is hardly affected by the pushing force.

Figure 21:
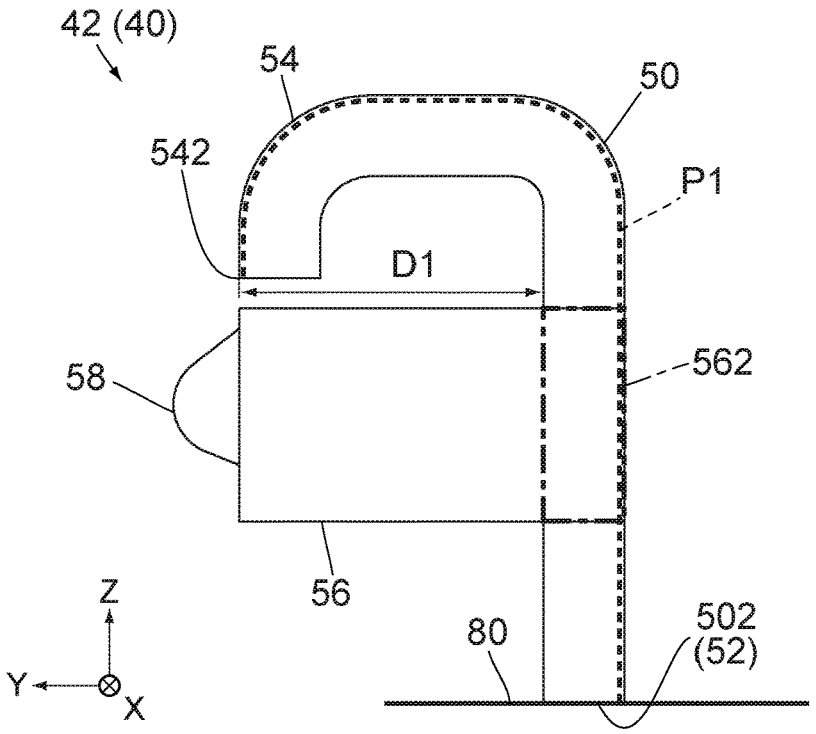
FIG. 21 is a rear view showing a positional relation among portions of a side portion of the additional member of FIG. 12, wherein dashed line shows a path along which a base portion and an armor portion extend, and chain dotted line shows an outline of the starting portion of the spring portion.

Referring to FIG. 21, the spring portion 56 extends from the aforementioned part that is hardly affected by the pushing force. More specifically, the spring portion 56 has the starting portion 562 at which the spring portion 56 starts and extends from the base portion 50 and which is nearer to the anchored portion 52 than to the innermost portion 542 of the armor portion 54. According to this arrangement, the starting portion 562, which is close to the anchored portion 52, is hardly moved even if the armor portion 54 is pushed by the mating connector 70 (see FIG. 15) to be resiliently or plastically deformed. Therefore, the spring portion 56 extending from the starting portion 562 and the projecting portion 58 supported by the spring portion 56 are hardly moved. According to the connector 10 (see FIG. 1) of the present embodiment, connection reliability of the projecting portion 58 to the mating connector 70 can be improved.

In the additional member 40 of the present embodiment, a position of the starting portion 562 of the spring portion 56 in the Y-direction is equal to another position of the anchored portion 52 in the Y-direction. In other words, a distance D0 (see FIG. 23) between the starting portion 562 and the anchored portion 52 in the Y-direction is zero. In contrast, the innermost portion 542 of the armor portion 54 is apart from the starting portion 562 by a distance D1 in the Y-direction. Thus, in the Y-direction, the distance D0 (see FIG. 23) between the starting portion 562 and the anchored portion 52 is smaller than the distance D1 between the starting portion 562 and the innermost portion 542. In other words, the starting portion 562 is nearer to the anchored portion 52 than to the innermost portion 542 in the Y-direction. According to the present embodiment, this arrangement facilitates to reduce the influence of the aforementioned pushing force on the spring portion 56.

According to the present embodiment, when the starting portion 562, the innermost portion 542 and the anchored portion 52 are seen along the X-direction, an imaginary path P1 that extends between the anchored portion 52 and the innermost portion 542 via the starting portion 562 can be defined. A path length (creeping distance) between the starting portion 562 and the anchored portion 52 along the path P1 is shorter than another path length (creeping distance) between the starting portion 562 and the innermost portion 542 along the path P1. In other words, when the starting portion 562, the innermost portion 542 and the anchored portion 52 are seen along the X-direction, the starting portion 562 is nearer to the anchored portion 52 than to the innermost portion 542 in an extending direction along which the base portion 50 and the armor portion 54 extend, or in a direction along the path P1. According to the present embodiment, this arrangement also facilitates to reduce the influence of the aforementioned pushing force on the spring portion 56.

Referring to FIG. 12, in the additional member 40 of the present embodiment, the flat-plate portion 504 of the base portion 50 securely resists the aforementioned downward pushing force because the flat-plate portion 504 is located just above the anchored portion 52. The spring portion 56 is hardly affected by the aforementioned pushing force because the spring portion 56 extends from the flat-plate portion 504.

According to the present embodiment, the connection reliability of the projecting portion 58 of the connector 10 to the mating connector 70 can be further improved. However, the spring portion 56 may extend from a part other than the flat-plate portion 504, provided that the spring portion 56 extends from the base portion 50. For example, the spring portion 56 may extend from the bent portion 506.

Figure 22:
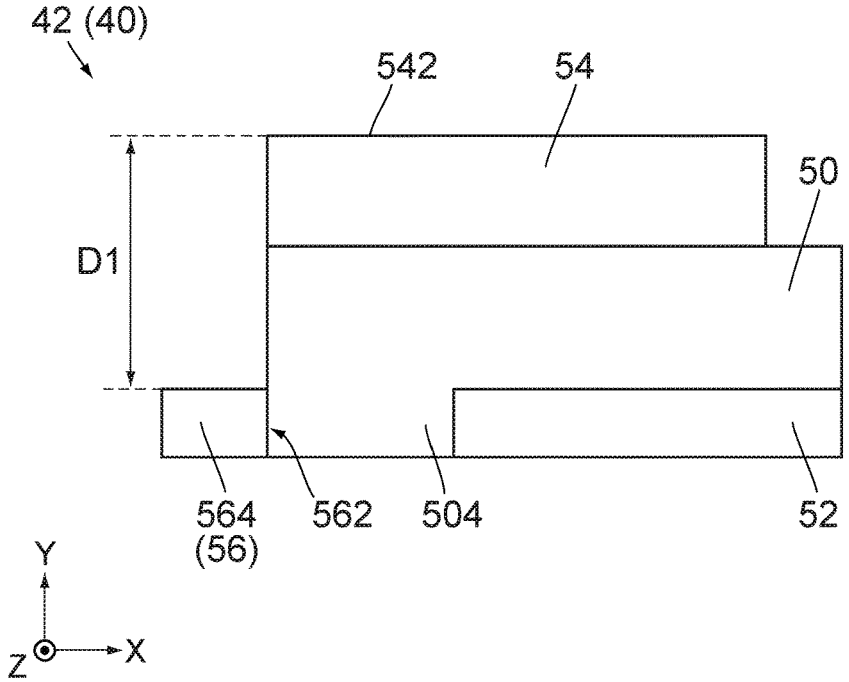
FIG. 22 is a view showing another positional relation among the portions of the side portion of FIG. 21 which is seen from above, wherein an outline of each of the portions is illustrated by continuous line even in a case where the outline is hidden under the other portion.

Referring to FIG. 22, in the additional member 40 of the present embodiment, a position of the armor portion 54 in the X-direction overlaps with another position of the anchored portion 52 in the X-direction. This arrangement facilitates to more efficiently disperse the aforementioned pushing force to the anchored portion 52. Therefore, the connection reliability of the projecting portion 58 (see FIG. 21) of the connector 10 (see FIG. 1) to the mating connector 70 (see FIG. 15) can be further improved. From the viewpoint of efficient dispersion of the aforementioned pushing force to the anchored portion 52, the position of the armor portion 54 in the X-direction is more preferred to be equal to or included in the position of the anchored portion 52 in the X-direction.

The present embodiment can be further variously modified as described below in addition to the already explained modifications.

Referring to FIG. 7, the additional member 40 may have the side portions 42, the coupling portion 44 and the outer protection portion 48 as necessary. In other words, the additional member 40 may have only the body portion 46. Moreover, the body portion 46 may have only the lock portion 62.

In the additional member 40, each of the first spring 564 and the second spring 566 of the spring portion 56 may have a part that extends downward so that each of the first spring 564 and the second spring 566 has a lower end that is located at a position same as that of the anchored portion 52. Moreover, the lower ends of the thus-extending first spring 564 and second spring 566 may be fixed to the circuit board 80 (see FIG. 1) via soldering, etc. According to this structure, the first spring 564 and the second spring 566 lose their spring properties when the connector 10 is used, while the spring portion 56, or the third spring 568, can be more securely prevented from being moved downward. Thus, the contact reliability of the projecting portion 58 of the connector 10 to the mating connector 70 can be further securely improved.

Figure 23:
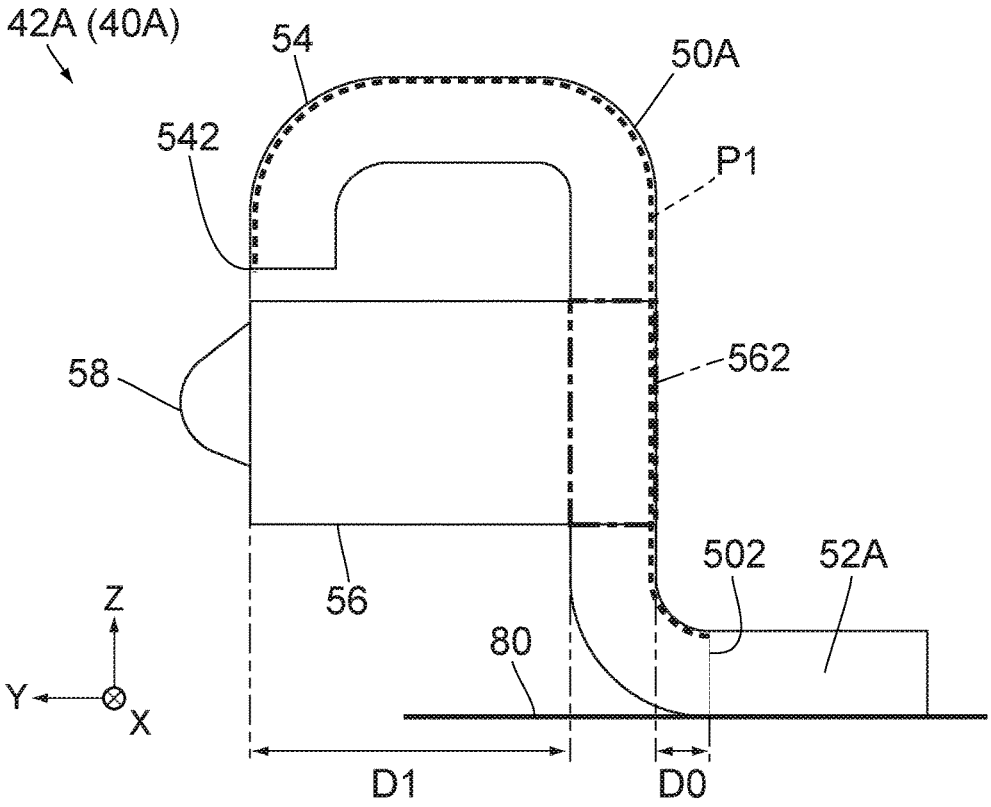
FIG. 23 is a rear view showing a modification of the positional relation of FIG. 21.
Figure 24:
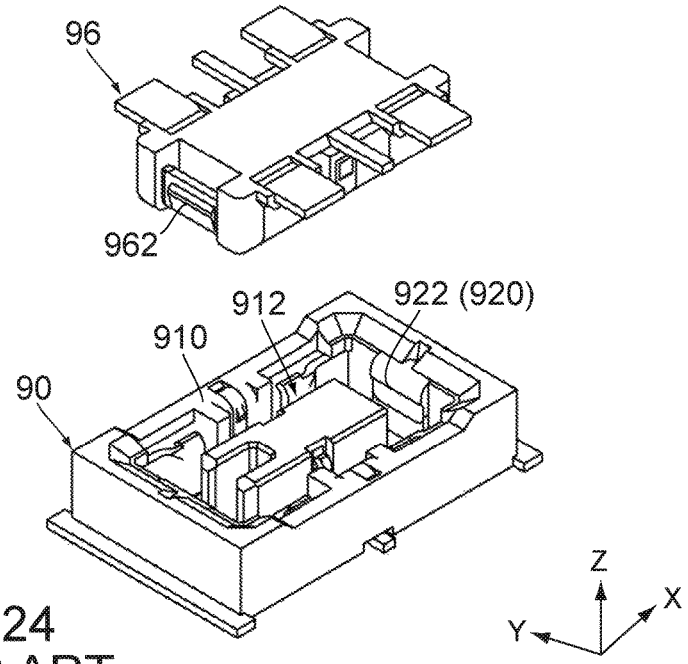
FIG.24 PRIOR ART
FIG. 24 is a perspective view showing a connector and a mating connector of Patent Document 1, wherein the mating connector is apart from the connector.
Figure 25:
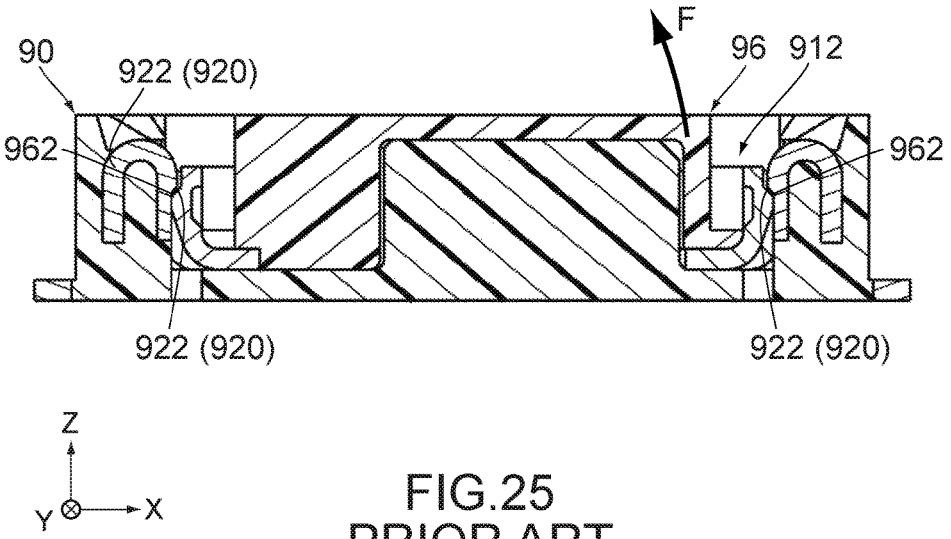
FIG.25 PRIOR ART
FIG. 25 is a cross-sectional view showing the connector and the mating connector of FIG. 24, wherein the mating connector is mated with the connector.

Referring to FIG. 23 together with FIG. 21, an additional member 40A according to a modification has a side portion 42A which is different from the side portion 42 of the additional member 40. The side portion 42A has a base portion 50A and an anchored portion 52A different from the base portion 50 and the anchored portion 52, respectively. However, the side portion 42A has a structure same as that of the side portion 42 except the aforementioned difference. The base portion 50A has a part that is located in the vicinity of a lower end thereof and that is bent to extend outward in the Y-direction. The anchored portion 52A extends outward in the Y-direction from the boundary portion 502 which is an outer end of the base portion 50A in the Y-direction.

The spring portion 56 of the present modification also has the starting portion 562 at which the spring portion 56 starts and extends from the base portion 50A and which is nearer to the anchored portion 52A than to the innermost portion 542 of the armor portion 54. In detail, in the Y-direction, the distance D0 between the starting portion 562 and the boundary portion 502 that defines a boundary of the anchored portion 52A is smaller than the distance D1 between the starting portion 562 and the innermost portion 542. Moreover, when the starting portion 562, the innermost portion 542 and the anchored portion 52A are seen along the X-direction, a creeping distance, or a distance along the path P1, between the starting portion 562 and the anchored portion 52A is smaller than another creeping distance between the starting portion 562 and the innermost portion 542. Referring to FIG. 3, according to the present modification, the contact reliability of the projecting portion 58 of the connector 10 to the mating connector 70 can be similarly improved.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mountable on an object in an upper-lower direction and mateable with a mating connector along the upper-lower direction, the mating connector having a received portion provided with two mating lock portions, wherein:

the connector has a length extending in a front-rear direction perpendicular to the upper-lower direction, and a width extending in a lateral direction perpendicular to the upper-lower direction and the front-rear direction, and the length of the connector is longer than the width of the connector;

the connector comprises a housing, terminals and two additional members;

the terminals and the additional members are held by the housing;

the housing has an outer wall, a projecting wall and a receiving portion;

the projecting wall projects upward in the upper-lower direction;

the outer wall surrounds the projecting wall in a horizontal plane perpendicular to the upper-lower direction;

the receiving portion is a space formed between the outer wall and the projecting wall and receives the received portion of the mating connector in a mated state in which the connector is mated with the mating connector;

each of the additional members has a portion mounted on the outer wall, and a body portion extending to the projecting wall from said portion mounted on the outer wall;

the body portion of each of the additional members has a lock portion;

the two lock portions are located at opposite sides of the projecting wall, respectively, in one of the front-rear direction and the lateral direction, and face the receiving portion; and in the mated state, the lock portions lock the locked portions, respectively, to maintain the mated state.

2. The connector as recited in claim 1, wherein:

each of the additional members has a held portion; and the held portion of each of the additional members extends from an upper end of the lock portion and is held by the projecting wall.

3. The connector as recited in claim 1, wherein the lock portion of each of the additional members has a depression or a projection that is exposed inside the receiving portion.

4. A connector mountable on an object in an upper-lower direction and mateable with a mating connector along the upper-lower direction, the mating connector having a received portion provided with two mating lock portions, wherein:

the connector has a length extending in a front-rear direction perpendicular to the upper-lower direction, and a width extending in a lateral direction perpendicular to the upper-lower direction and the front-rear direction, and the length of the connector is longer than the width of the connector;

the connector comprises a housing, terminals and two additional members;

the terminals and the additional members are held by the housing;

the housing has an outer wall, a projecting wall and a receiving portion;

the projecting wall projects upward in the upper-lower direction;

the outer wall surrounds the projecting wall in a horizontal plane perpendicular to the upper-lower direction;

the receiving portion is a space formed between the outer wall and the projecting wall and receives the received portion of the mating connector in a mated state in which the connector is mated with the mating connector;

each of the additional members has a lock portion;

the two lock portions are located at opposite sides of the projecting wall, respectively, in one of the front-rear direction and the lateral direction, and face the receiving portion;

in the mated state, the lock portions lock the locked portions, respectively, to maintain the mated state;

the housing has one or more bottom holes;

the receiving portion opens downward via the bottom holes of the housing;

each of the additional members has a fixed portion to be fixed to the object; and the fixed portion of each of the additional members extends from a lower end of the lock portion and is located inside one of the bottom holes.

5. The connector as recited in claim 4, wherein:

each of the additional members has an inner protection portion; and the inner protection portion of each of the additional members extends upward from the fixed portion and partially covers the outer wall.

6. A connector mountable on an object in an upper-lower direction and mateable with a mating connector along the upper-lower direction, the mating connector having a received portion provided with two mating lock portions, wherein:

the connector has a length extending in a front-rear direction perpendicular to the upper-lower direction, and a width extending in a lateral direction perpendicular to the upper-lower direction and the front-rear direction, and the length of the connector is longer than the width of the connector;

the connector comprises a housing, terminals and two additional members;

the terminals and the additional members are held by the housing;

the housing has an outer wall, a projecting wall and a receiving portion;

the projecting wall projects upward in the upper-lower direction;

the outer wall surrounds the projecting wall in a horizontal plane perpendicular to the upper-lower direction;

the receiving portion is a space formed between the outer wall and the projecting wall and receives the received portion of the mating connector in a mated state in which the connector is mated with the mating connector;

each of the additional members has a lock portion;

the two lock portions are located at opposite sides of the projecting wall, respectively, in one of the front-rear direction and the lateral direction, and face the receiving portion;

in the mated state, the lock portions lock the locked portions, respectively, to maintain the mated state;

each of the additional members has two side portions, a coupling portion and a body portion;

in each of the additional members, the two side portions are located across the receiving portion in the lateral direction, the coupling portion couples the side portions to each other, and the body portion extends from the coupling portion and has the lock portion;

each of the side portions has an anchored portion, a base portion, an armor portion, a spring portion and a projecting portion;

the anchored portion of each of the side portions is configured to be fixed to the object;

in each of the side portions, the base portion extends upward from the anchored portion and is located outside the receiving portion in the lateral direction, the armor portion extends inward in the lateral direction from the base portion, the spring portion extends from the base portion, and the projecting portion is supported by the spring portion and projects inward in the lateral direction;

when each of the side portions is seen from above along the upper-lower direction, the spring portion is, at least in part, covered by the armor portion, and the projecting portion is, at least in part, located in the receiving portion to be visible; and in each of the side portions, the spring portion has a starting portion at which the spring portion starts and extends from the base portion and which is nearer to the anchored portion than to an innermost part of the armor portion that is located to be innermost in the lateral direction.

7. The connector as recited in claim 6, wherein the spring portion of each of the side portions has a U-like or J-like shape in the horizontal plane.

8. The connector as recited in claim 6, wherein:

the base portion of each of the side portions has a flat-plate portion of a flat-plate shape; and in each of the side portions, the spring portion extends from the flat-plate portion.

9. The connector as recited in claim 6, wherein the projecting portion of each of the side portions is pressed against and brought into contact with the mating connector in the mated state.

10. The connector as recited in claim 6, wherein in each of the side portions, a position of the armor portion in the front-rear direction is equal to or overlaps with another position of the anchored portion in the front-rear direction.

* * * * *